US008430797B2

(12) United States Patent
Wan

(10) Patent No.: US 8,430,797 B2
(45) Date of Patent: Apr. 30, 2013

(54) SUPPORT FOR SUPPORTING A BICYCLE USED AS AN EXERCISER

(76) Inventor: Kuo Hui Wan, Hsinchu (TW)

( * ) Notice: Subject to any disclaimer, the term of this patent is extended or adjusted under 35 U.S.C. 154(b) by 0 days.

(21) Appl. No.: 13/095,929

(22) Filed: Apr. 28, 2011

(65) Prior Publication Data

US 2011/0287901 A1 Nov. 24, 2011

Related U.S. Application Data

(63) Continuation-in-part of application No. 12/785,543, filed on May 24, 2010, now Pat. No. 8,029,419.

(51) Int. Cl.
*A63B 69/16* (2006.01)

(52) U.S. Cl.
USPC ..... 482/61

(58) Field of Classification Search ..... 482/51, 482/54, 57, 58, 59, 60, 61; 434/61, 247, 434/255; 601/34, 35, 36
See application file for complete search history.

(56) References Cited

U.S. PATENT DOCUMENTS

| | | | | | |
|---|---|---|---|---|---|
| 593,105 | A * | 11/1897 | Kingsbury | 482/61 |
| 3,905,597 | A * | 9/1975 | Tabb | 482/61 |
| 4,082,265 | A * | 4/1978 | Berkes | 482/61 |
| 4,580,983 | A * | 4/1986 | Cassini et al. | 482/61 |
| 4,802,666 | A * | 2/1989 | Rodriqguez | 482/61 |
| 4,925,183 | A * | 5/1990 | Kim | 482/61 |
| 4,932,651 | A * | 6/1990 | Defaux | 482/61 |
| 4,958,832 | A * | 9/1990 | Kim | 482/61 |
| 6,530,864 | B1 * | 3/2003 | Parks | 482/4 |
| 6,857,992 | B1 * | 2/2005 | Kolda et al. | 482/61 |
| 7,520,842 | B2 * | 4/2009 | Comair et al. | 482/61 |
| 7,883,449 | B2 * | 2/2011 | Wan | 482/57 |
| 2005/0209064 | A1 * | 9/2005 | Peterson et al. | 482/61 |

* cited by examiner

*Primary Examiner* — Oren Ginsberg

(57) ABSTRACT

A support for a bicycle includes a front unit, a rear adjust unit, a front roller unit, a rear roller unit and a connection unit. Different sizes of bicycles can be connected to the support. The rear adjust unit, the front roller unit and the rear roller unit are adjustable to obtain different operation modes. The support is equipped with sensing system to be cooperated with software and hardware so as to perform as a video game.

9 Claims, 5 Drawing Sheets

SUPPORT FOR SUPPORTING A BICYCLE USED AS AN EXERCISER

This is a Continuation-In-Part application of the applicant's former patent application Ser. No. 12/785,543, filed on May 24, 2010 now U.S. Pat. No. 8,029,419, The present invention relates to a support, and more particularly, to a support for supporting a bicycle and providing multiple exercising modes.

FIELD OF THE INVENTION

Background of the Invention

A conventional support for a bicycle is shown in FIG. 1 and generally includes a front unit 1 with a swinging frame 3 connected thereto, and a rear unit 2 with a restriction frame 4 connected thereto. The restriction frame 4 restricts the wheel axle. Rollers 6 are connected to both of the front and rear units 1, 2, and a connection member 7 is connected between the rollers 6 on the front and rear units 1, 2. When the bicycle 5 is operated, the rear wheel drives the rollers 6 on the rear unit 2 and the rollers 6 on the front unit 1 are rotated.

However, the rollers 6 are connected to the front and rear units 1, 2 so that the users can only experience the mode of cycling on smooth roads. If the users want to change the mode and feel the cycling on rough roads, the rollers 6 have to be replaced and this is inconvenient for the users and requires significant time. Besides, the conventional support cannot be adjusted so that the users cannot experience the cycling on slopes.

The present invention intends to provide a support for a bicycle and the support can provide multiple different cycling modes.

SUMMARY OF THE INVENTION

The present invention relates to a support for a bicycle and comprises a front unit, a rear adjust unit, a front roller unit, a rear roller unit and a connection unit. By adjusting the rear adjust unit, the bicycle on the support of the present invention simulates the cycling on different slopes.

The surfaces of the rollers of the front roller unit and the rear roller unit can be changed, and the front roller unit and the rear roller unit are movable so that the exerciser on the support of the present invention can simulate different road conditions.

The exerciser on the support of the present invention can be equipped with a sensing system which is cooperated computers to make the operation of the bicycle perform as a video game.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
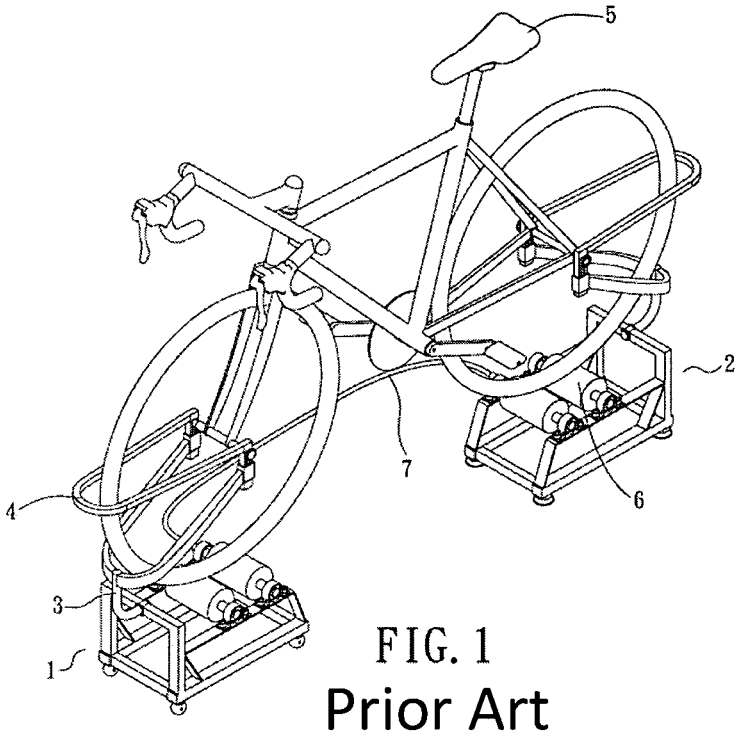
FIG. 1 Prior Art
FIG. 1 shows a conventional support and a bicycle.
Figure 2:
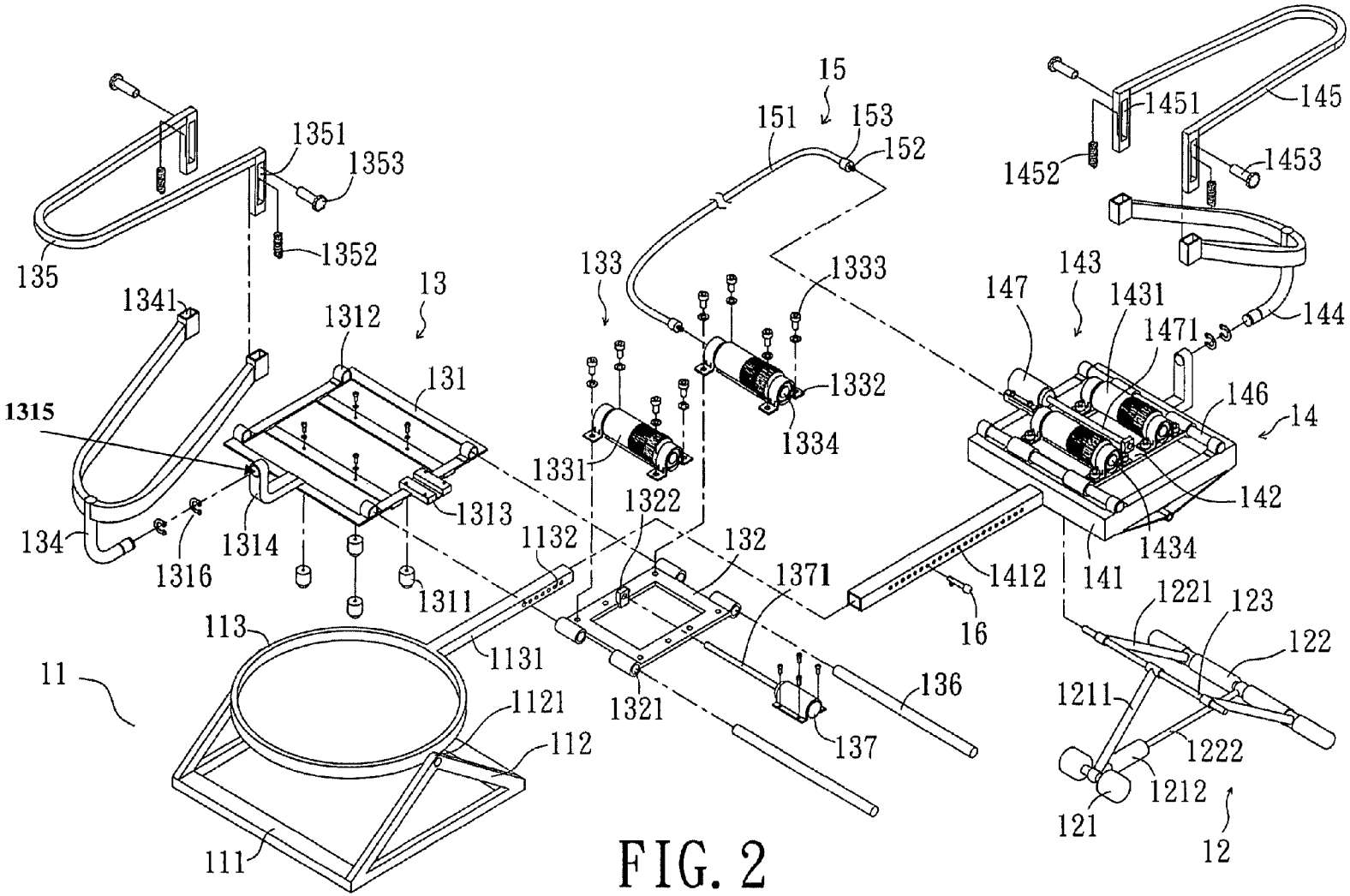
FIG. 2 is an exploded view to show the support of the present invention.
Figure 3:
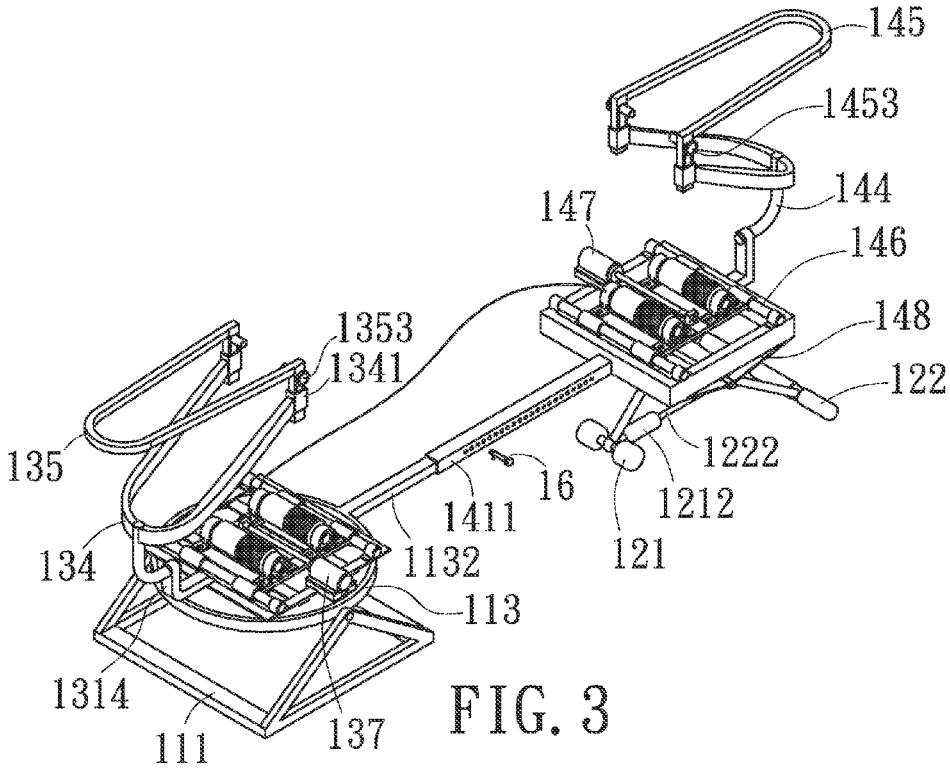
FIG. 3 is a perspective view to show the support of the present invention.
Figure 4:
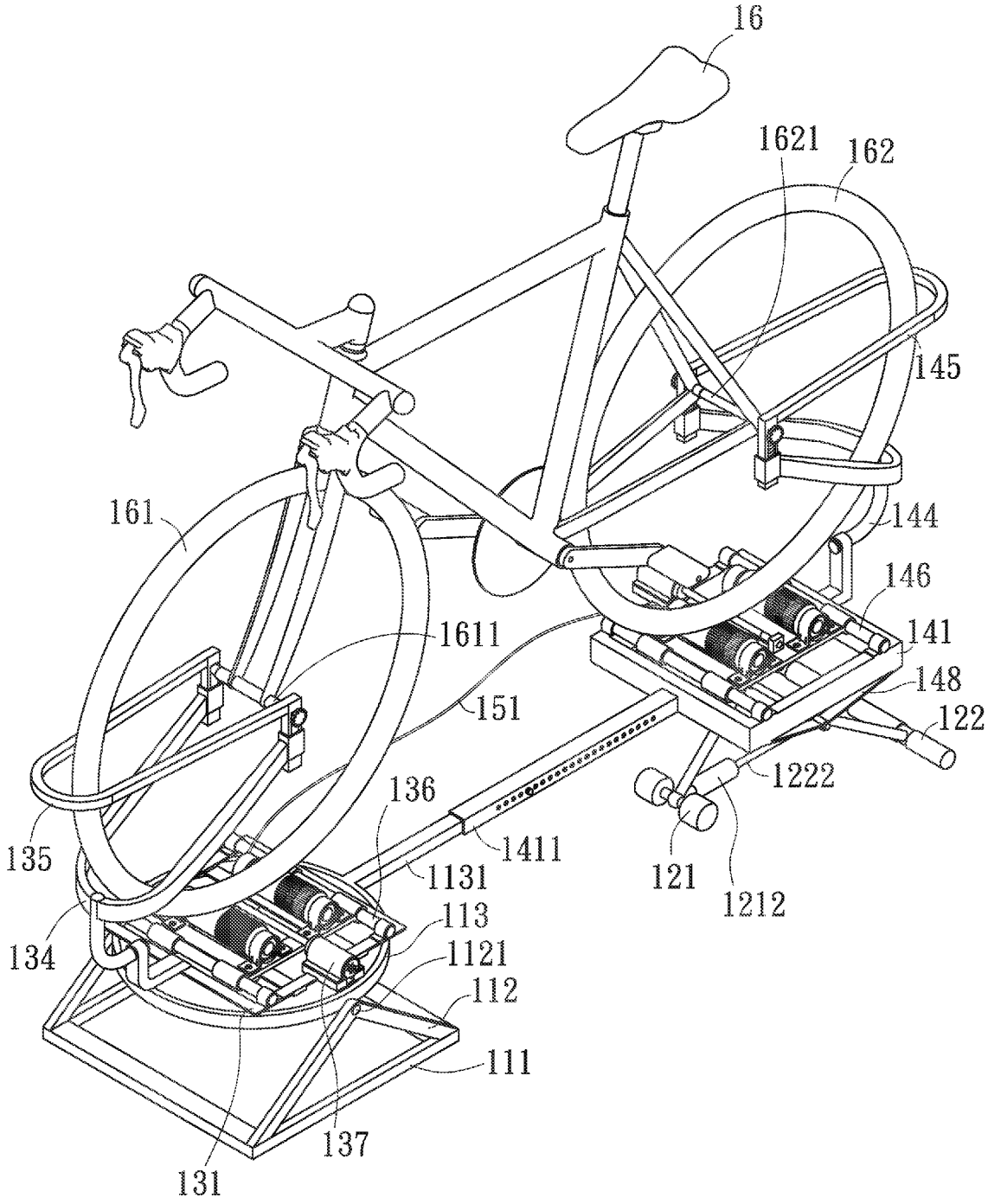
FIG. 4 is a perspective view to show a bicycle is supported on the support of the present invention.

Referring to FIGS. 2 to 4, the support of the present invention comprises a front unit 11 having a front base 111 and side trusses 112 on two sides of the front base 111 so as to form a frame. A support frame 113 is pivotably connected on the two respective tops 1121 of the side trusses 112 of the front unit 11. The support frame 113 has a recessed area and has a front adjust rod 1131 extending therefrom. Multiple holes 1121 are defined through the front adjust rod 1131 which is cooperated with the rear adjust rod 1411 on the rear roller unit 14 by using a pin 16 to adjust the distance between the front unit 11 and a rear adjust unit 12.

The rear adjust unit 12 has a front portion 121 and a rear portion 122, the front portion 121 has a first support 1211 and an adjust portion 1212 extending therefrom. The rear portion 122 has two parallel second supports 1221 and an adjust link 1222 extending therefrom, wherein a transverse rod 123 is connected to the first support 1211 and the second supports 1221. The transverse rod 123 is connected to side trusses 148 on the underside of the rear roller unit 14. The adjust portion 1212 is mounted to an end of the adjust link 1222 to make the rear adjust unit 12 be a cone-shaped mechanism. The adjust link 1222 is retractable relative to the adjust portion 1212 to adjust the height of the rear roller unit 14. The adjust portion 1212 can be a cylinder or a nut.

A front roller unit 13 has a base 131, a movable part 132, a roller unit 133, a swinging part 134, and a fixing frame 135. The base 131 of the front roller unit 13 has multiple slide members 1311 pivotably connected thereto which are rollers or made by material with low friction such as plastic or Acrylic. The base 131 has multiple holes 1312 defined in four corners thereof and a support member 1313 extends from an end of the base 131 so that an adjust member 137 is connected on the support member 1313.

The movable part 132 is connected between two sets of holes 1312 of the base 131 and includes tubes 1321 on two ends thereof. The rods 136 extend through the holes 1312 and the tubes 1321 so as to connect the movable part 132 to the base 131, such that the movable part 132 is moved left and right on the base 131.

The movable part 132 has a connection member 1322 and an extension rod 1371 is connected to the connection member 1322. The extension rod 1371 is connected to the adjust member 137 and retractable or fixed relative to the adjust member 137. The adjust member 137 can be a hydraulic cylinder or a nut.

The roller unit 133 has rollers 1331, U-shaped connection caps 1332 and bolts 1333. The two sides of the rollers 1331 are engaged within the connection caps 1332 and the bolts 1333 threadedly connect the connection caps 1332 and the movable part 132. The rollers 1331 are rotatable on the movable part 132 and have several sections of different types of patterns.

An L-shaped rod 1314 extends from the base 131 and a hole 1315 is defined through the L-shaped rod 1314. A bearing 1316 is engaged with the hole 1315 so that an end of the swinging part 134 is pivotably connected to the L-shaped rod 1314.

The swinging part 134 is a Y-shaped member and the end of the swinging part **134*i* is connected to the hole 1315 of the L-shaped rod 1314 by the bearing 1316. The swinging part 134 has a vertical slot 1341 defined therein and the fixing frame 135 extends through the vertical slot 1341**.

The fixing frame 135 is a U-shaped member with two extensions on two ends thereof and each extension has a recess 1351 defined therein and a resilient member 1352 is received in the recess 1351.

The rear roller unit 14 is same as the front roller unit 13 and has a base 141, a movable part 142, a roller unit 143, a swinging part 144, and a fixing frame 145. The movable part 142 is movable on the base 141 by the rods 146. The connection of the extension rod 1471 and the adjust member 147 controls the movement of the movable part 142. The difference from the front roller unit 13 is that the slide member 1311 is pivotably connected to the underside of the front roller unit 13, but the rear roller unit 14 has side trusses 148 connected on the underside of the two sides thereof. A transverse rod 123 connects the rear adjust unit 12 and the trusses 148 of the rear roller unit 14.

The rear roller unit 14 has a rear adjust rod 1411 extending therefrom which is a hollow rod in which the front adjust rod 1131 is inserted. The rear adjust rod 1411 has holes defined therethrough so that a pin 16 extends through aligned holes 1132, 1412 of the front and rear adjust rods 1131, 1411 to adjust the distance between the front unit 11 and the rear adjust unit 12, such that different sizes of bicycles 16 can be installed.

A connection unit 15 has an outer tube 151 in which an inner tube 152 is inserted, and a pivotal member 153. The pivotal member 153 is pivotably connected with the axles 1334, 1434 of the rollers 1331, 1431 of the front and rear roller units 13, 14. When the rollers 1431 of the rear roller unit 14 rotate, the inner tube 152 is rotated by the rotation of the axle 1434.

When the users want to exercise by using a bicycle 16, the bicycle 16 is simply put on the support of the present invention and the front adjust rod 1131 and the rear adjust rod 1411 are properly adjusted. Using a pin 16 to extend through the aligned holes 1132, 1412 of the front adjust rod 1131 and the rear adjust rod 1411. The front wheel 161 and the rear wheel 162 are respectively put on the swinging parts 134, 144 and the fixing frames 135, 145. The pins 1353, 1453 extend through the recesses 1351, 1451 and the axles 1611, 1621 of the front and rear wheels 161, 162 of the bicycle 16. The resilient members 1352, 1452 are engaged beneath the pins 1353, 1453. The front and rear wheels 161, 162 are respectively put on the rollers 1331, 1431 of the front roller unit 13 and the rear roller unit 14.

When the user pedals the pedals to drive the rear wheel 162, the rollers 1431 on the rear roller unit 14 are rotated and the inner tube 152 is rotated. The rollers 1331 of the front roller unit 13 and the front wheel 161 are rotated. Because the swinging parts 134, 144 are pivotable and the base 131 of the front roller unit 13 has slide members 1311, so that the bicycle 16 can tilt left and right to simulate real biking experience.

The rollers 1331,1431 of the front and rear roller units 13, 14 have different patterns, and the front and rear roller units 133, 143 can swing by the pivotal movement of the movable parts 132, 142 on the bases 131, 141 so that the different patterns on the rollers 1331, 1431 can simulate different road conditions.

Figure 5:
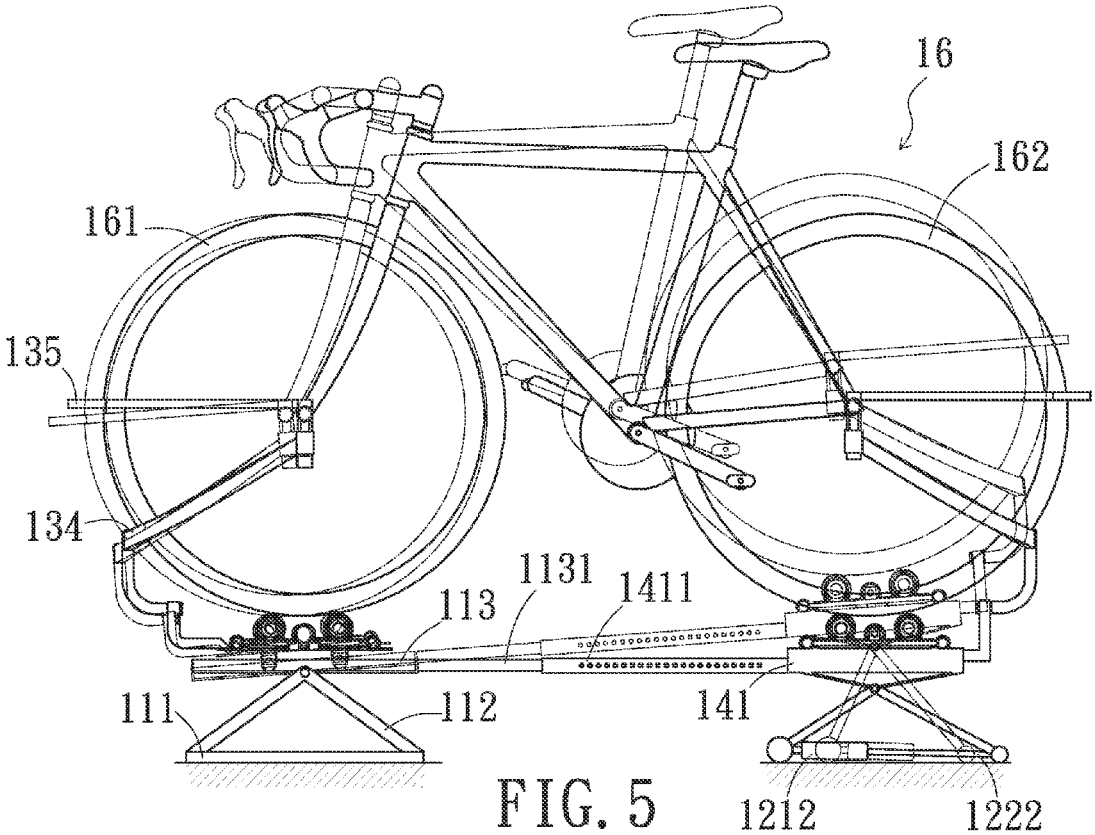
FIG. 5 is a side view to show the bicycle is supported on the support of the present invention.

The rear adjust unit 12 is adjusted by adjusting the adjust link 1222 so that the angle between the first and second supports 1211, 1221 is adjusted. The rear roller unit 14 can be adjusted its height so simulate the bicycle 16 is operated on slopes as shown in FIG. 5.

Figure 6:
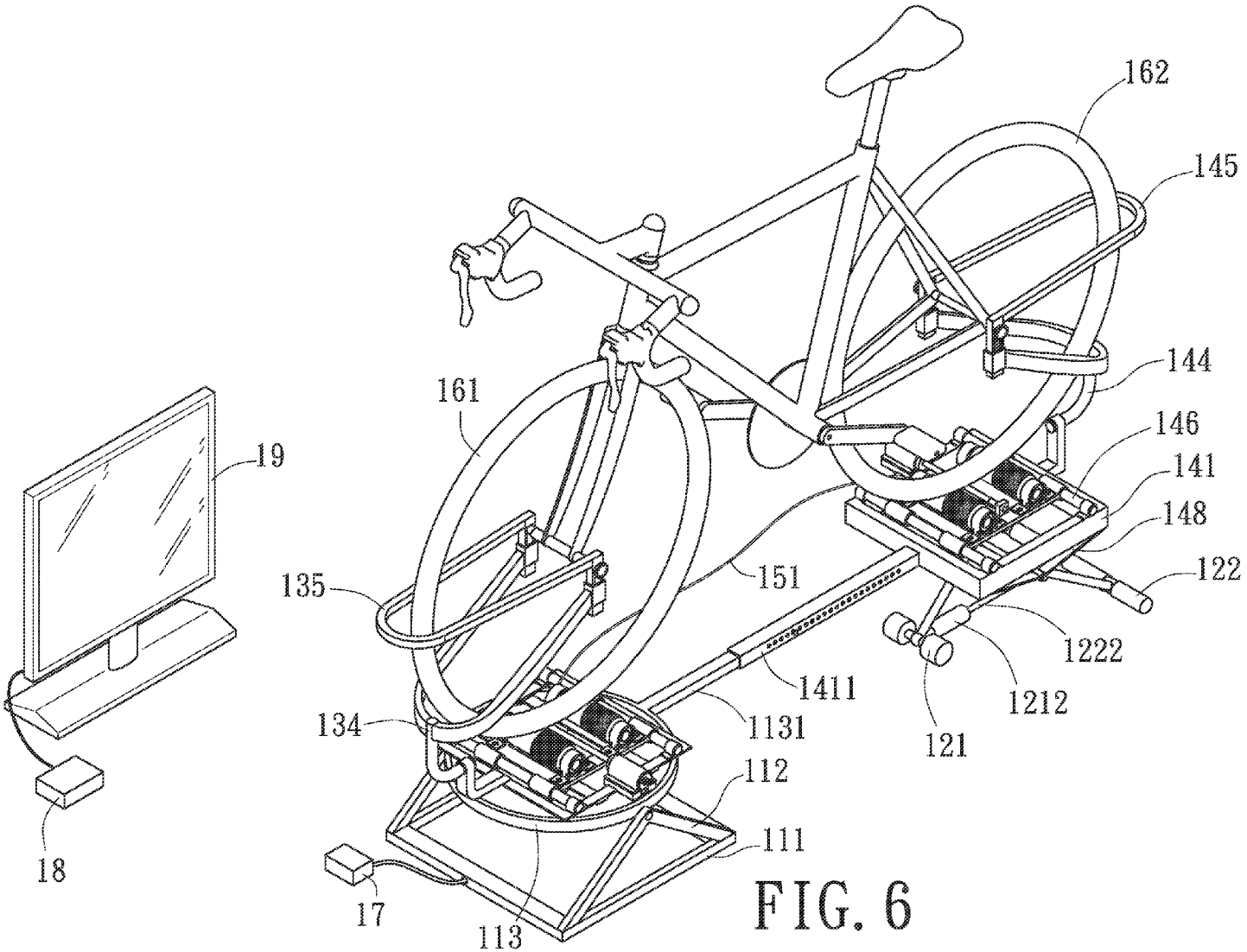
FIG. 6 shows another application of the bicycle and the support of the present invention.

As shown in FIG. 6, sensing systems (not shown) are respectively connected to the support frame 113, the rollers 1331, 1431, the rear adjust unit 12 and the swinging part 134 so as to detect the direction, speed and slopes of the bicycle 16. The data that sensed by the sensing systems are collected to an emitting device 17 which emits signals which are received by a receiving device 18. A decoding system 19 decodes the signals and transfers the signals into images. The decoding system 19 can be a computer with a monitor and this arrangement allows the operation of the bicycle 16 to perform like a video game.

While we have shown and described the embodiment in accordance with the present invention, it should be clear to those skilled in the art that further embodiments may be made without departing from the scope of the present invention.

What is claimed is:

1. A support for a bicycle, comprising:

a front unit having a front base and side trusses, a support frame connected on a top of the front base, the support frame having a front adjust rod extending therefrom, multiple holes defined through the front adjust rod;

a rear adjust unit having a front portion and a rear portion, the front portion having a first support and an adjust portion extending therefrom, the rear portion having second supports and an adjust link extending therefrom, a transverse rod connected to the first support and the second supports, the transverse rod connected to side trusses on an underside of a rear roller unit;

a front roller unit and the rear roller unit each having a base, a movable part, a roller unit, a swinging part, and a fixing frame;

each base having a support member extending therefrom and an adjust member connected on the support member, an L-shaped rod extending from the base and a hole defined through the L-shaped rod;

each movable part having tubes connected thereto and rods extending through the tubes so as to connect the movable part to a respective base, the movable part having a connection member and an extension rod connected to the connection member;

each roller unit having rollers, connection plugs and bolts;

each swinging part is connected to a respective L-shaped rod and has a vertical slot defined therein;

each fixing frame having a recess defined therein and a resilient member received in the recess, each fixing frame connected to an axle of a wheel by a pin; and a connection unit having an outer tube, an inner tube and a pivotal member, the pivotal member pivotably connected with axles of the rollers of the roller units.

2. The support as claimed in claim 1, wherein the base of the front roller unit has multiple slide members pivotably connected thereto which are rollers or made by material with low friction such as plastic or Acrylic.

3. The support as claimed in claim 1, wherein the adjust portion and the adjust member are cylinders or nuts.

4. The support as claimed in claim 1, wherein the swinging part is connected to the L-shaped rod by a bearing.

5. A support for a bicycle, comprising:

a front unit having a front base and side trusses, a support frame connected on a top of the front base, the support frame having a front adjust rod extending therefrom, multiple holes defined through the front adjust rod;

a rear adjust unit having a front portion and a rear portion, the front portion having a first support and an adjust portion extending therefrom, the rear portion having second supports and an adjust link extending therefrom, a transverse rod connected to the first support and the second supports, the transverse rod connected to side trusses on an underside of a rear roller unit;

a front roller unit and the rear roller unit each having a base, a movable part, a roller unit, a swinging part, and a fixing frame;

each base having a support member extending therefrom and an adjust member connected on the support member, an L-shaped rod extending from the base and a hole defined through the L-shaped rod;

each movable part having tubes connected thereto and rods extending through the tubes so as to connect the movable part to a respective base, the movable part having a connection member and an extension rod connected to the connection member;

each roller unit having rollers, connection plugs and bolts;

each swinging part is connected to a respective L-shaped rod and a vertical slot defined therein;

each fixing frame having a recess defined therein and a resilient member received in the recess, each fixing frame connected to an axle of a wheel by a pin;

a connection unit having an outer tube, an inner tube and a pivotal member, the pivotal member pivotably connected with axles of the rollers of the roller units;

an emitting device electrically connected on the bicycle;

a receiving device receiving signals emitted from the emitting device; and a decoding system decoding the signals from the receiving device and transferring the signals into images.

6. The support as claimed in claim 5, wherein the base of the front roller unit has multiple slide members pivotably connected thereto which are rollers or made by material with low friction such as plastic or Acrylic.

7. The support as claimed in claim 5, wherein the adjust portion and the adjust member are cylinders or nuts.

8. The support as claimed in claim 5, wherein the swinging part is connected to the L-shaped rod by a bearing.

9. The support as claimed in claim 5, wherein the receiving device and the decoding system are installed in a single hardware, or in two separated hardware.

* * * * *